US008181392B1

(12) United States Patent
Farber

(10) Patent No.: US 8,181,392 B1
(45) Date of Patent: May 22, 2012

(54) AUTOMATIC GATE ARM DAMAGE PREVENTION SYSTEM

(76) Inventor: Raymond E. Farber, Boulder, CO (US)

( * ) Notice: Subject to any disclaimer, the term of this patent is extended or adjusted under 35 U.S.C. 154(b) by 278 days.

(21) Appl. No.: 12/571,852

(22) Filed: Oct. 1, 2009

(51) Int. Cl.
*E01F 13/00* (2006.01)

(52) U.S. Cl. ..... 49/49; 49/4; 49/226; 49/234; 49/232; 404/6; 404/9; 404/10

(58) Field of Classification Search ..... 49/9, 49, 49/226, 227, 232, 234, 233; 404/6, 9, 10
See application file for complete search history.

(56) References Cited

U.S. PATENT DOCUMENTS

| | | | | |
|---|---|---|---|---|
| 1,535,753 | A * | 4/1925 | Weiser | 246/128 |
| 1,628,651 | A * | 5/1927 | Burress | 49/9 |
| 1,665,157 | A * | 4/1928 | Dahnke | 49/247 |
| 1,945,295 | A * | 1/1934 | Pranger | 49/192 |
| 2,874,493 | A * | 2/1959 | Mandel | 49/34 |
| 4,364,200 | A * | 12/1982 | Cobb | 49/192 |
| D272,313 | S | 1/1984 | Jenkins | |
| D293,764 | S | 1/1988 | Hansen | |
| 5,469,660 | A | 11/1995 | Tamenne | |
| 5,653,058 | A | 8/1997 | Zaimins | |
| 5,671,563 | A * | 9/1997 | Marcum | 49/49 |
| 5,884,432 | A | 3/1999 | DeLillo | |
| 6,212,825 | B1 * | 4/2001 | Hopkins, Jr. | 49/49 |
| 6,370,821 | B1 * | 4/2002 | McCord et al. | 49/34 |
| 6,672,088 | B2 | 1/2004 | Ueda | |
| 7,065,923 | B2 | 6/2006 | Parsadayan et al. | |
| 7,997,824 | B2 * | 8/2011 | Amengual Pericas | 404/6 |

FOREIGN PATENT DOCUMENTS

FR 2681887 A1 * 4/1993

* cited by examiner

*Primary Examiner* — Katherine W Mitchell
*Assistant Examiner* — Marcus Menezes

(57) ABSTRACT

An automatic gate arm damage prevention system includes a lift arm that is coupled to a lifting apparatus. The lift arm has an outer end, an upper side, a lower side, a first lateral side and a second lateral side. A channel extends into the outer end and the upper side so that the channel is bounded by the first and second lateral sides and the lower side. An elongated member has a first end and a second end. The first end is positioned in the channel. A pivot pin extends through the channel and through the elongated member and the lift arm to pivotally couple the elongated member to the lift arm. The second end is pivotable upwardly with respect to the lift arm.

4 Claims, 6 Drawing Sheets

AUTOMATIC GATE ARM DAMAGE PREVENTION SYSTEM

BACKGROUND OF THE DISCLOSURE

1. Field of the Disclosure

The disclosure relates to gate arm damage prevention devices and more particularly pertains to a new gate arm damage prevention device for inhibiting damage caused to a vehicle by a gate arm striking the vehicle.

2. Summary of the Disclosure

An embodiment of the disclosure meets the needs presented above by generally comprising a lift arm that is coupled to a lifting apparatus. The lift arm has an outer end, an upper side, a lower side, a first lateral side and a second lateral side. A channel extends into the outer end and the upper side so that the channel is bounded by the first and second lateral sides and the lower side. An elongated member has a first end and a second end. The first end is positioned in the channel. A pivot pin extends through the channel and through the elongated member and the lift arm to pivotally couple the elongated member to the lift arm. The second end is pivotable upwardly with respect to the lift arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
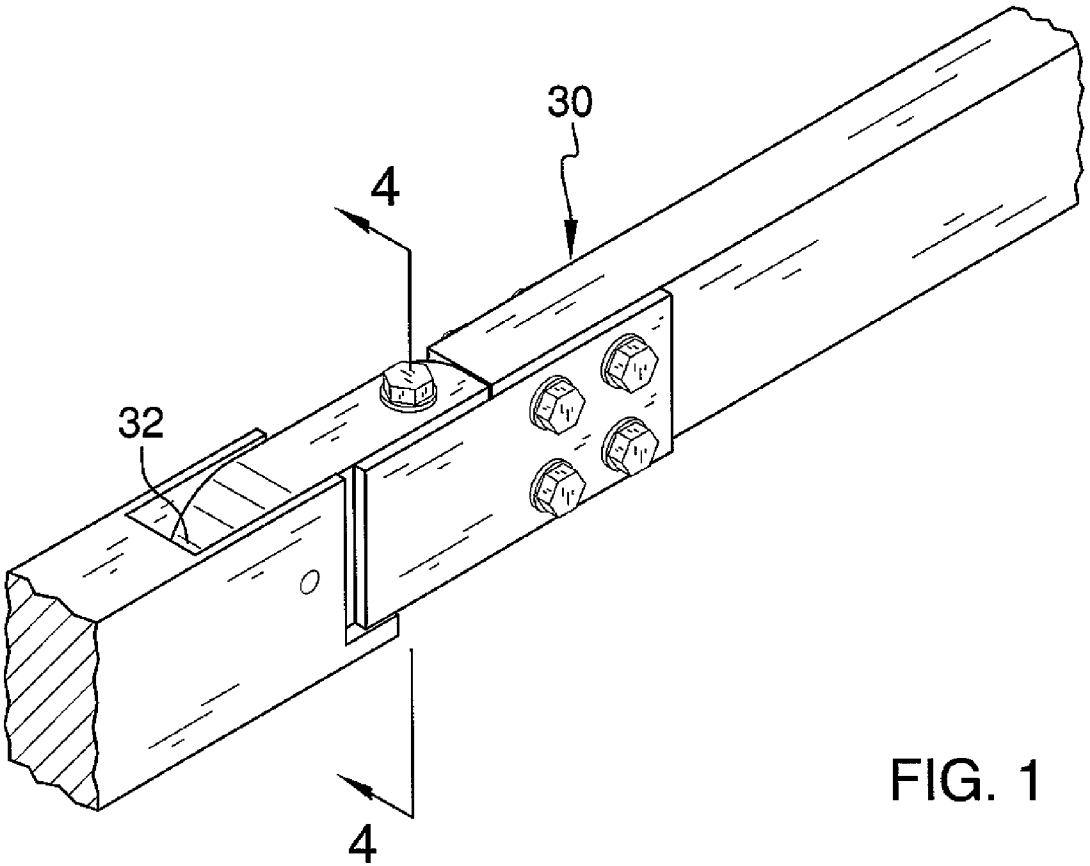
FIG. 1 is a broken front perspective view of an automatic gate arm damage prevention system according to an embodiment of the disclosure.
Figure 2:
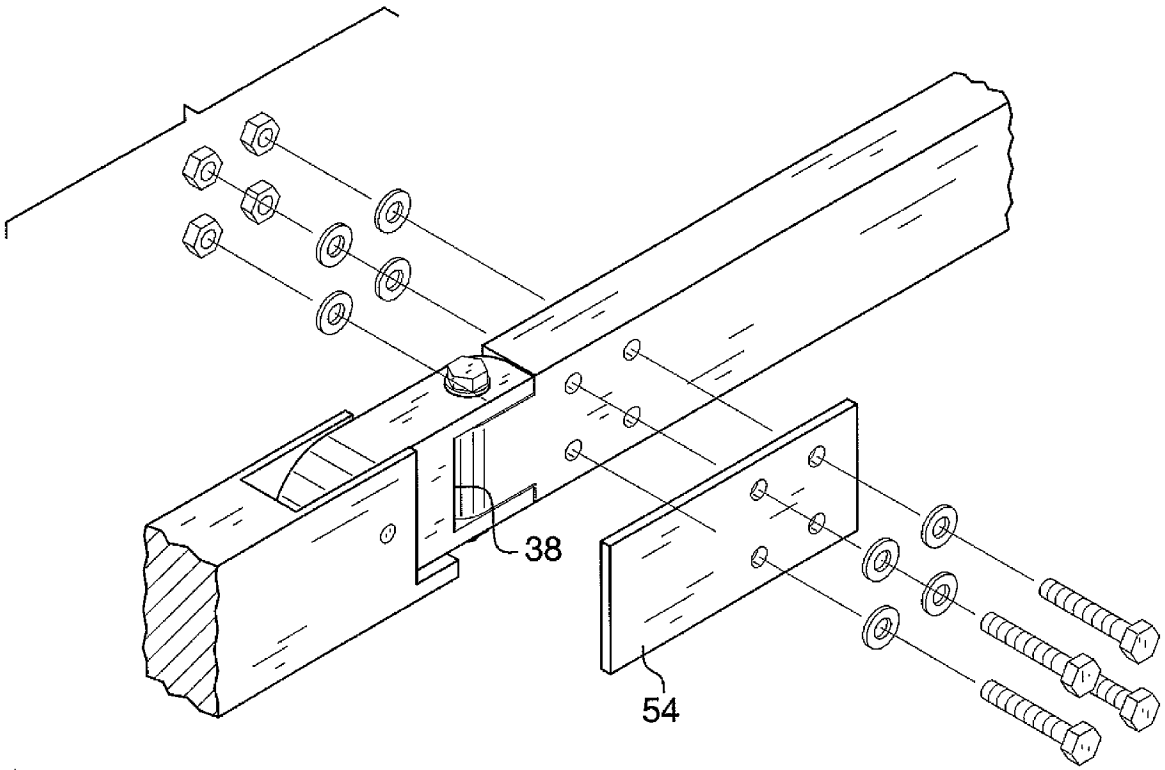
FIG. 2 is a broken exploded front perspective view of an embodiment of the disclosure.
Figure 3:
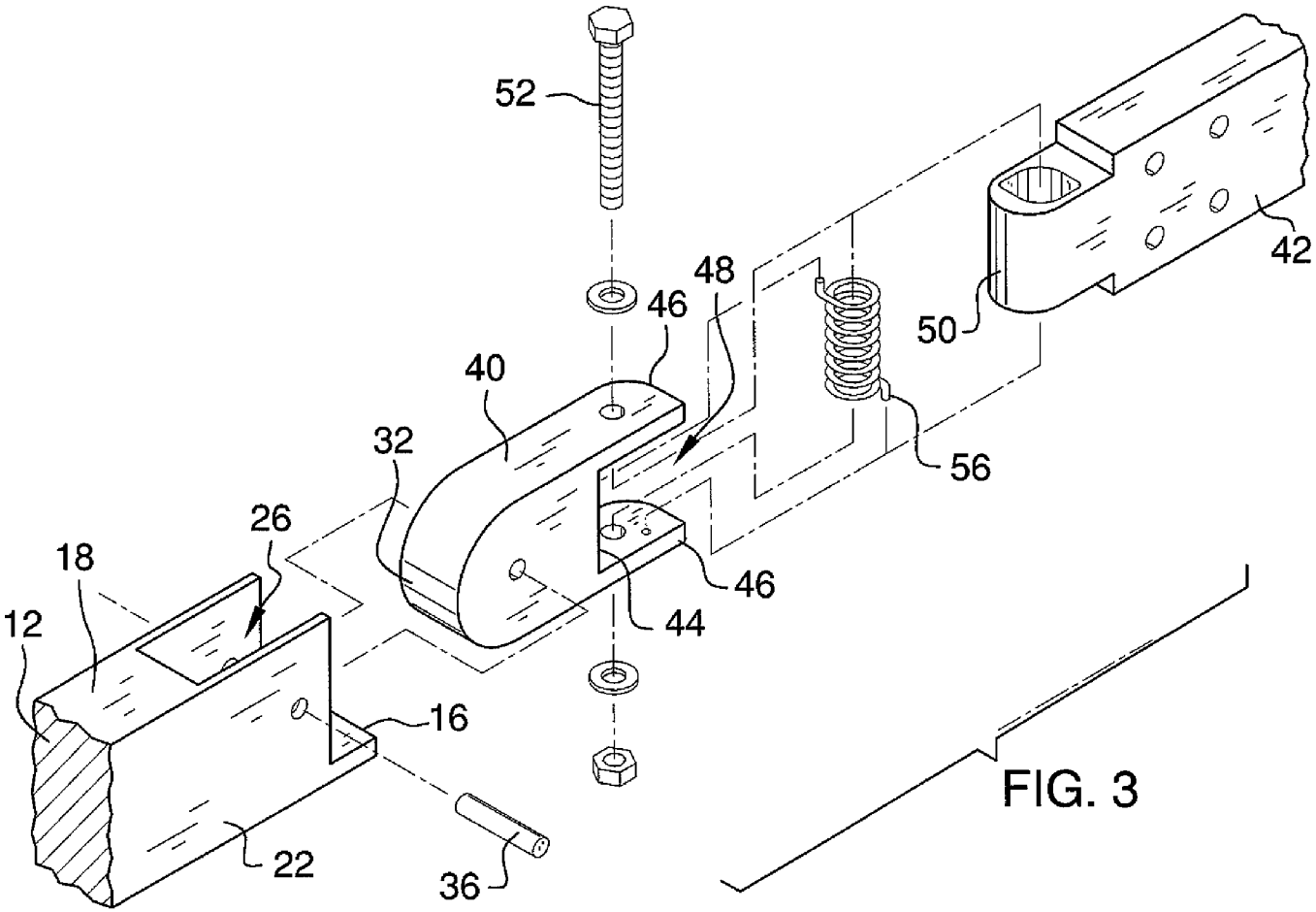
FIG. 3 is a broken exploded front perspective view of an embodiment of the disclosure.

With reference now to the drawings, and in particular to FIGS. 1 through 7 thereof, a new gate arm damage prevention device embodying the principles and concepts of an embodiment of the disclosure and generally designated by the reference numeral 10 will be described.

As best illustrated in FIGS. 1 through 7, the automatic gate arm damage prevention system 10 generally comprises a lift arm 12 that is coupled to a lifting apparatus 14. The lifting apparatus 14 may comprise any conventional gate lifting device and typically the type used which by automated system to allow vehicles to pass through an entryway or exit. The lift arm 12 has an outer end 16. The lift arm 12 has an upper side 18, a lower side 20, a first lateral side 22 and a second lateral side 24. A channel 26 extends into the outer end 16 and the upper side 18 so that the channel 26 is bounded by the first 22 and second 22 lateral sides and the lower side 20. This forms a shelf 28 between the channel 26 and the lower side 20.

An elongated member 30 has a first end 32 and a second end 34. The first end 32 is positioned in the channel 26. A pivot pin 36 extends through the channel 26 and through the elongated member 30 and the lift arm 24 to pivotally couple the elongated member 30 to the lift arm 12. The second end 34 is pivotable upwardly with respect to the lift arm 12. The shelf 16 prevents the elongated member 30 from moving beyond an approximately horizontal orientation.

The elongated member 30 has a break 38 therein positioned nearer to the first end 32 than the second end 34 to define a first section 40 and a second section 42 of the elongated member 30. The first section 40 includes the first end 32 and is only pivotable in a vertical direction. The first section 40 has a distal end 44 with respect to the lift arm 12. A pair of supports 46 is attached to the distal end 44 and extends outwardly therefrom to define a receiving slot 48 positioned between the supports 46. The supports 46 are vertically spaced from each other. The second section 42 includes a proximal end 50 with respect to the lift arm 12. The proximal end 50 is positioned in the receiving slot 48. A pivot rod 52 extends through the supports 46 and the second section 42 to allow the second section 42 to laterally pivot with respect to the first section 40.

Figure 4:
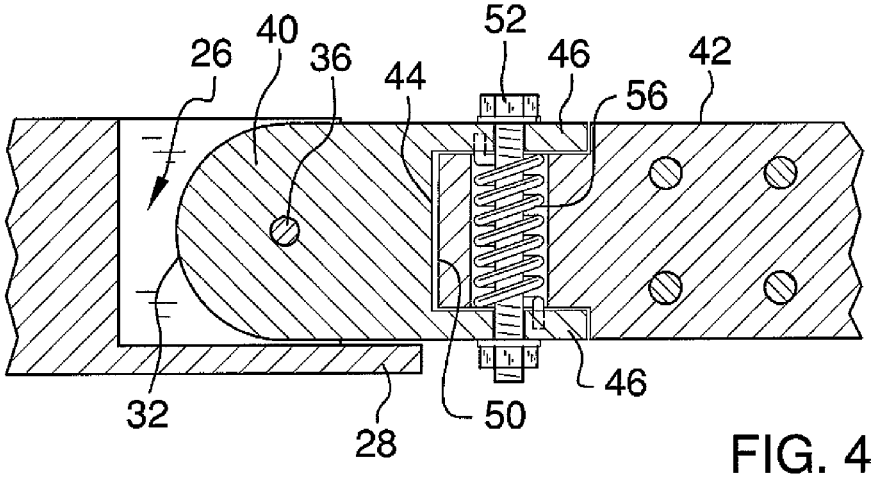
FIG. 4 is a broken cross-sectional view taken along line 4-4 of FIG. 1 of an embodiment of the disclosure.
Figure 5:
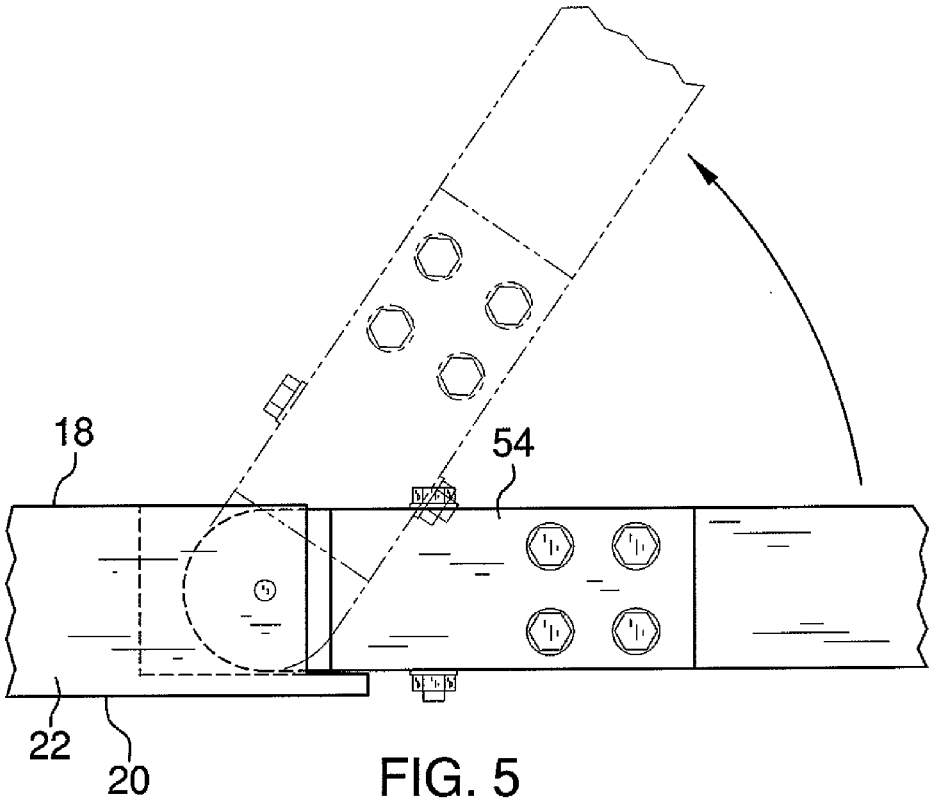
FIG. 5 is a broken front view of an embodiment of the disclosure.
Figure 6:
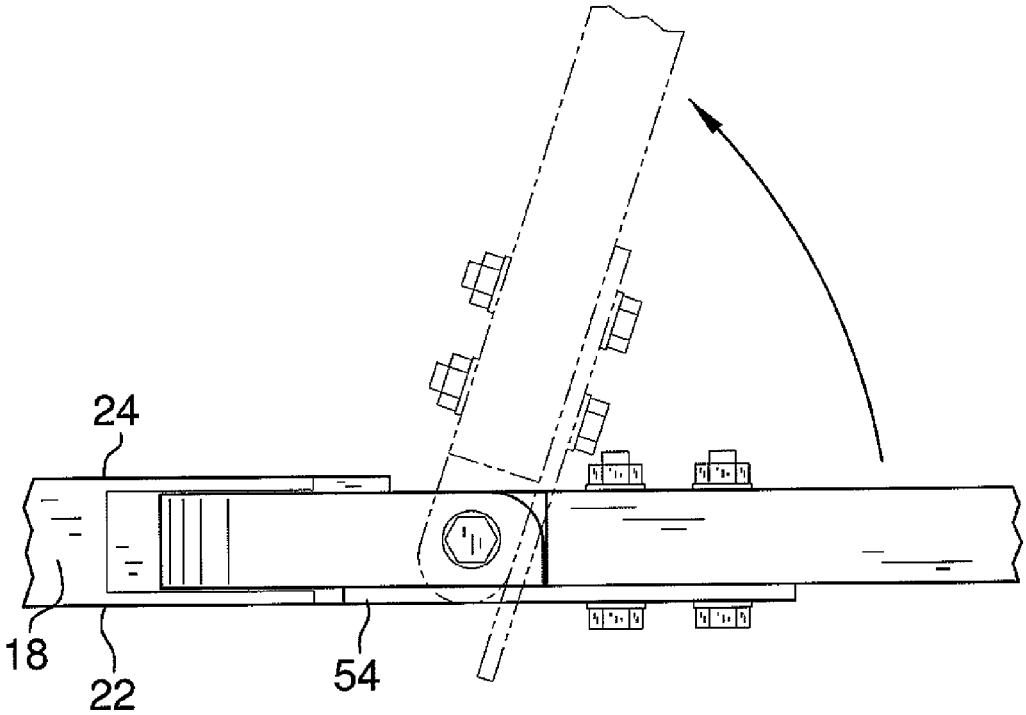
FIG. 6 is a broken top view of an embodiment of the disclosure.
Figure 7:
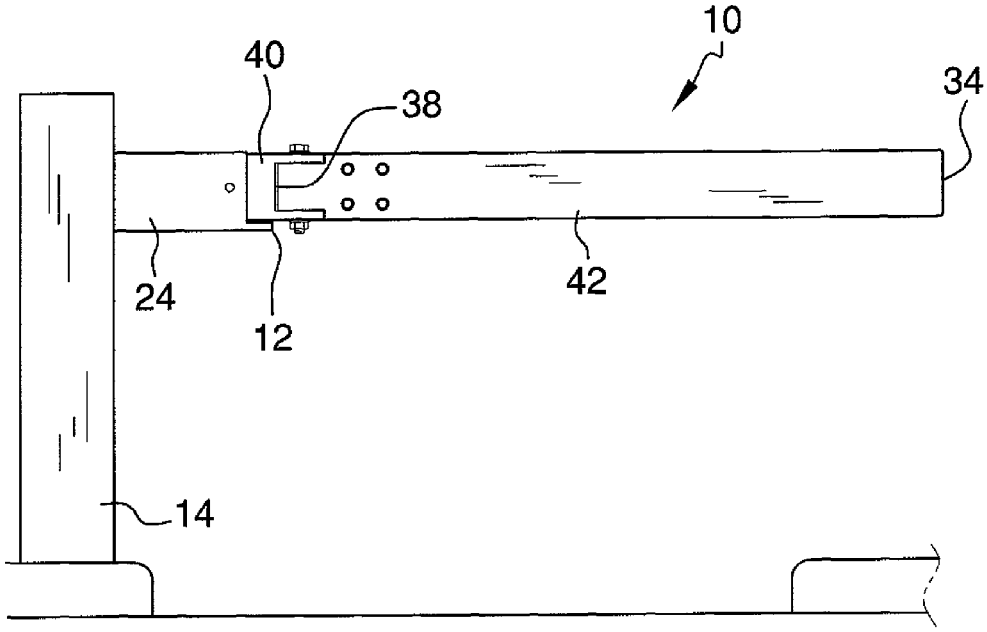
FIG. 7 is a front view of an embodiment of the disclosure.

A stop 54 is attached to the second section 42 to restrict pivoting of the second section to only a first direction away from a straight line extending through the first 32 and second 34 ends when the first section 40 is aligned with the second section 42. A biasing member 56 is mounted to the first 40 and second 42 sections and biases the second section 42 into alignment with the first section 40. The biasing member 56 may be used in conjunction with the stop 54 by biasing the stop 54 against the first section 40 as shown in FIG. 4.

In use, the system 10 is used in a conventional manner to block access to an entry or an exit. However, should the lifting apparatus 14 malfunction or a vehicle become stuck in the path of the lift arm 12, the elongated member 30 will pivot to prevent excessive damage, such as denting, to the vehicle. The first 40 and second 42 sections will pivot upwardly if the lifting arm 12 is brought down toward the vehicle and the second section 42 will pivot laterally if the lifting arm 12 is either swung towards the vehicle prematurely or if the vehicle does not stop in time to avoid the elongated member 30. In this fashion, the system 10 may be used on both vertical and horizontally actuated gates.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A gate arm assembly to inhibit damage to a vehicle, said assembly including:

a lift arm being coupled to a lifting apparatus, said lift arm having an outer end, said lift arm having an upper side, a lower side, a first lateral side and a second lateral side, a channel extending into said outer end and said upper side so that said channel is bounded by said first and second lateral sides and said lower side; and an elongated member having a first end and a second end, said first end being positioned in said channel, a pivot pin extending through said channel and through said elongated member and said lift arm to pivotally couple said elongated member to said lift arm, said second end being pivotable upwardly with respect to said lift arm, wherein said elongated member is vertically movable upwardly when said lift arm is moved vertically downward by said lifting apparatus; and wherein said elongated member has a break therein positioned nearer to said first end than said second end to define a first section and a second section of said elongated member, said first section including said first end and being only pivotable in a vertical direction, said first section having a distal end with respect to said lift arm, a pair of supports being attached to said distal end and extending outwardly therefrom to define a receiving slot positioned between said supports, said supports being vertically spaced from each other, said second section including a proximal end with respect to said lift arm, said proximal end being positioned within said receiving slot, a pivot rod extending through said supports and said second section to allow said second section to laterally pivot with respect to said first section.

2. The assembly according to claim 1, further including a stop being attached to said second section to restrict pivoting of said second section to only a first direction away from a straight line extending through said first and second ends when said first section is aligned with said second section.

3. The assembly according to claim 1, further including a biasing member being mounted to said first and second sections and biasing said second section into alignment with said first section.

4. A gate arm assembly to inhibit damage to a vehicle, said assembly including:

a lift arm being coupled to a lifting apparatus, said lift arm having an outer end, said lift arm having an upper side, a lower side, a first lateral side and a second lateral side, a channel extending into said outer end and said upper side so that said channel is bounded by said first and second lateral sides and said lower side;

an elongated member having a first end and a second end, said first end being positioned in said channel, a pivot pin extending through said channel and through said elongated member and said lift arm to pivotally couple said elongated member to said lift arm, said second end being pivotable upwardly with respect to said lift arm, wherein said elongated member is vertically movable upwardly when said lift arm is moved vertically downward by said lifting apparatus;

said elongated member having a break therein positioned nearer to said first end than said second end to define a first section and a second section of said elongated member, said first section including said first end and being only pivotable in a vertical direction, said first section having a distal end with respect to said lift arm, a pair of supports being attached to said distal end and extending outwardly therefrom to define a receiving slot positioned between said supports, said supports being vertically spaced from each other, said second section including a proximal end with respect to said lift arm, said proximal end being positioned within said receiving slot;

a pivot rod extending through said supports and said second section to allow said second section to laterally pivot with respect to said first section;

a stop being attached to said second section to restrict pivoting of said second section to only a first direction away from a straight line extending through said first and second ends when said first section is aligned with said second section; and a biasing member being mounted to said first and second sections and biasing said second section into alignment with said first section.

* * * * *